United States Patent [19]

Pellerin

[11] 3,939,562

[45] Feb. 24, 1976

[54] UTENSILS FOR EATING STRANDS OF FOODS

[76] Inventor: Emery A. Pellerin, 194 Smith St., Lasalle City, Quebec, Canada

[22] Filed: Jan. 17, 1975

[21] Appl. No.: 541,789

Related U.S. Application Data

[63] Continuation-in-part of Ser. No. 521,841, Nov. 7, 1974, abandoned.

[52] U.S. Cl. ..... 30/147; 30/149

[51] Int. Cl.[2] ..... A47J 43/28

[58] Field of Search ..... 30/147, 149, 322, 325, 30/324, 142, 150, 326

[56] References Cited

UNITED STATES PATENTS

| | | | |
|---|---|---|---|
| 868,583 | 10/1907 | Schuyler | 30/149 |
| 1,781,973 | 11/1930 | Bolton | 30/149 X |
| 3,121,951 | 2/1964 | Green | 30/149 |
| 3,138,871 | 6/1964 | Sears | 30/322 |
| 3,552,017 | 1/1971 | Smuts | 30/322 |

FOREIGN PATENTS OR APPLICATIONS

| | | | |
|---|---|---|---|
| 7,946 | 12/1909 | United Kingdom | 30/149 |
| 378,936 | 8/1923 | Germany | 30/325 |

*Primary Examiner*—Al Lawrence Smith
*Assistant Examiner*—J. C. Peters
*Attorney, Agent, or Firm*—Roland L. Morneau

[57] ABSTRACT

Utensils for eating strands of food such as spaghetti. The primary utensil is a spoon-type utensil having means for cutting strands of food. The cutting means is formed by two edges defining a tapering slot in which strands are cut. One edge of the slot is the rim of the bowl of the utensil. The other edge is provided by a diverging portion of a member overlying a portion of the bowl. The slot may also be provided in the bowl from the rim and towards the center of the bowl. A fork utensil can also be provided, specifically adapted for use with the spoon-type utensil.

16 Claims, 11 Drawing Figures

UTENSILS FOR EATING STRANDS OF FOODS

This application is a Continuation-In-Part of application Ser. No. 521,841, filed on Nov. 7, 1974 now abandoned.

This invention is directed toward eating utensils.

The invention is more particularly directed toward eating utensils for use in eating strands of food, particularly food such as spaghetti.

Spaghetti is often eaten using a fork and spoon. The spaghetti is picked up with a fork and the fork is then placed in the bowl of the spoon, with its tines facing the concave surface of the bowl. The fork is then rotated in the bowl to wind the hanging strands of spaghetti about the fork into a compact mass so that the spaghetti can be conveniently eaten. However, it often happens that all the strands do not wind up when the fork is rotated. The strands that are left hanging from the fork make it awkward to eat the spaghetti.

It is the purpose of the present invention to provide utensils which make it less awkward to eat spaghetti.

The utensils of the present invention can be used to cut strands of food, which might otherwise hang from the fork, leaving a compact bundle of food on the fork which can be easily managed.

The invention is particularly directed toward a spoon-type utensil for use in eating strands of food, such as spaghetti. The utensil has a handle and a dished bowl attached to one end of the handle. Means are provided on the utensil for cutting strands of food which might hang from the utensil as it is being used in winding up strands.

The cutting means preferably comprises two edges forming a tapered slot for catching strands, at least one of the cutting edges having a cutting surface.

One embodiment of the slot consists of a tapered slot provided in the bowl of the spoon, the said slot opens through the rim of the bowl and tapers down in the direction of the center of the bowl. In a preferred alternative embodiment, the slot curves into a spiral-shape progressing towards the center of the bowl.

In another embodiment, one of the edges is formed by an edge of a portion of a member which overlies the bowl, the portion diverging away from the bowl. The other edge is formed by a portion of the rim adjacent the portion of the member.

A fork utensil can be provided that is particularly adapted for use with the spoon-type utensil.

The invention will now be described in detail having reference to the accompanying drawings in which.

Figure 1:
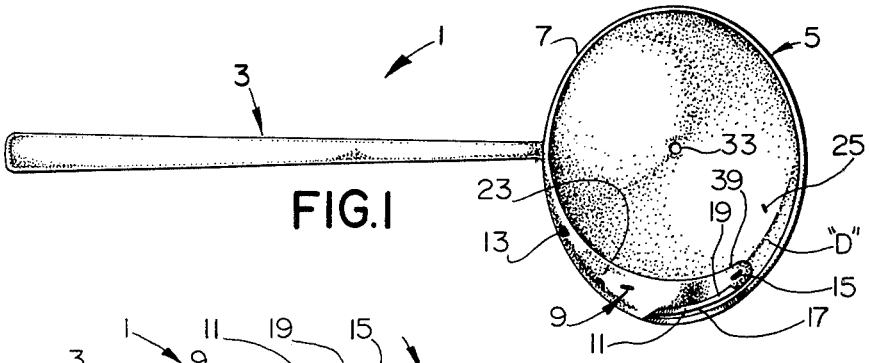
FIG. 1 is a plan view of the spoon-type utensil of the present invention.
Figure 2:
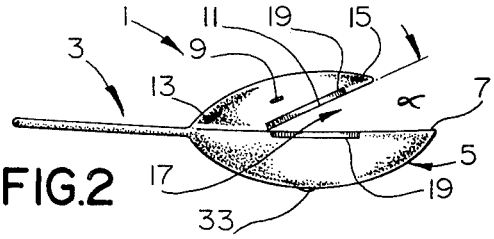
FIG. 2 is an elevation view of the utensil shown in FIG. 1.

The spoon-type utensil 1 of the present invention has a handle 3 and a dished bowl 5. The bowl 5 is relatively shallow and has a rim 7 to which one end of the handle 3 is attached.

A somewhat crescent-shaped member 9 overlies a portion of one side of the bowl 5. The member 9 is attached to a portion of the rim 7 of the bowl 5 along a portion of its outer, convexlike edge 11 at one end 13. The other end 15 of the member diverges away from the bowl forming a tapering slot 17 between the diverging free portion of convex edge 11 and that portion of the rim 7 adjacent end 15. The slot 17 has an angle $\alpha$ between 15°and 45°, and preferably is about 30°.

The slot 17 serves to catch any strands of food which may hang over the rim 7 of the bowl as a fork, carrying the strands, is centered against the bowl and rotated to twist the strands about the fork. The fork is rotated clockwise, as shown by arrow A, in order to catch strands in slot 17. At least one, and preferably both edges defining the slot 17, have a sharp, cutting surface 19 to cut hanging strands moved into the slot 17. The rim 7 serves to guide the strands into the slot 17.

The member 9 is a portion of a dome and is preferably curved down from its free end 15 toward its end 13 which is attached to the bowl. This provides a somewhat concave inner surface 23 facing the concave inner surface 25 of bowl 5. With this arrangement, the food strands are twisted into more of a ball shape around the fork as they roll under the free end 15 of the member 9, and the following concave surface 25.

Figure 4:
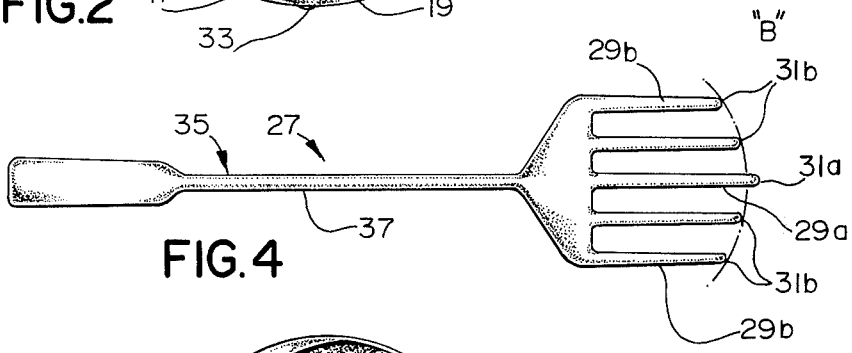
FIG. 4 is a plan view of a fork utensil for use with the spoon.

The fork for holding the food strands, and winding them on the fork using the bowl of spoon to shape the wound mass, can be an ordinary table fork. Preferably however, the fork used is constructed in a specific manner for use with the spoon. As shown in FIG. 4, the fork 27 can have a plurality of tines 29, the tines 29 having different lengths so that the ends 31b of the tines 29 form a plane B following substantially the same curve as the inner concave surface 25 of the bowl 5. As the fork is pressed against surface 25 in approximately the center of the bowl 5 and rotated, the ends 31b of the tines 29 will closely follow surface 25.

Preferably the fork is provided with an odd-number of tines and the middle tine 29*a* is lengthened to extend past the plane B. A slight depression 33 is provided at the bottom of the bowl 5 into which the end 31*a* of the center tine 29*a* is inserted when using the fork. The fork can then be easily rotated about the depression 33 and an axis C projecting therefrom and containing tine 29*a*. The depression 33 anchors the fork at one point during rotation. Instead of a depression 33, a centering through hole could be used instead. The handle 35 of the fork can have a narrow rounded portion 37 adjacent the tines 29 to facilitate the twisting of the fork with the fingers.

A major portion of the inner concave edge 39 of the member 9 preferably follows part of an imaginary curved line D which follows a cylindrical surface whose axis is centered over the depression 33. Edge 39 is only slightly farther from depression 33 than the distance between center tine 29*a* and the outer edge of outer tines 29*b* of the fork.

Figure 3:
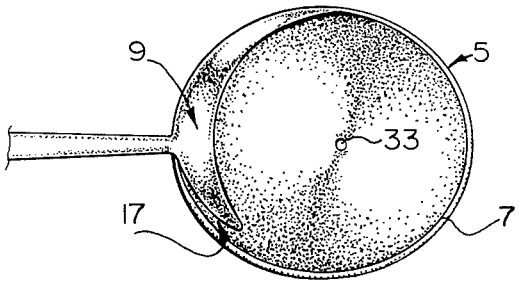
FIG. 3 is a plan view of another embodiment of the utensil of FIG. 1.

The member 9 can be made separately and attached by any suitable means such as welding to the rim 7 of the bowl 5. Preferably however, the member 9 forms an integral part of the spoon-type utensil. The utensil 1 thus preferably is made by stamping it out, including the bowl 5, handle 3, and member 9 in one piece. The bowl 5 is then dished and the member 9 is then folded and press-formed to shape the bowl 5. When the member 9 is made integral with the rest of the spoon, it must, of necessity, be offset to one side of the handle as shown in FIG. 1. If the member 9 is made separate from the bowl 5 however, it can be positioned in front of handle as shown in FIG. 3.

The utensils 1 and 27 can be made from suitable metal material. Alternatively, they can be made from suitable thermoplastic material. Regardless of the material used, the edges 7, 11 defining slot 17 can have serrated cutting surfaces 19 instead of sharp cutting surfaces.

In operation, the right hand holds the fork and the left hand holds the spoon. A bunch of strands of spaghetti is picked up with the tines 29 of the fork. The tine 31 is positioned in the recess 33 of the spoon. The handle 3 (FIG. 1) is held in a tilted position so that the apex of the slot 17 is raised in a clockwise direction. The strands are twisted in the bowl 5 in a clockwise direction until the desired ball size is obtained. Then, the handle 3 of the spoon is brought downwardly so as to rotate the cup 5 counterclockwise and consequently to cut the hanging strands with the wedged slot 17.

It should be obvious that a left-handed person would preferably hold the fork with his left hand and the spoon with his right hand. In this case, the crescent-shaped member 9 would be located over the bowl 5 on the opposite side relative to the handle 3.

Additional embodiments of the invention are also contemplated and consist of a tapered slot provided in the bowl of the spoon, the said slot opens through the rim of the bowl and tapers down in the direction of the center of the bowl. In a preferred alternative embodiment, the slot curves into a spiral-shape progressing towards the center of the bowl.

The additional embodiments illustrated in FIGS. 6 to 11 comprise a handle and a bowl wherein the slot is provided in the bowl of the spoon-type utensil.

Figure 6:
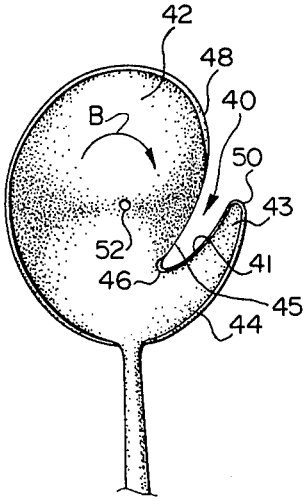
FIGS. 6 and 7 are a top and side views respectively of another embodiment of the spoon-type utensil.
Figure 7:
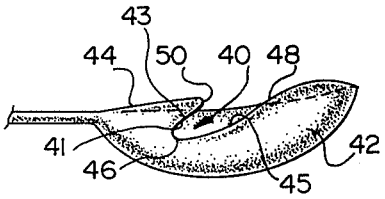

In FIGS. 6 and 7, a slot 40 is cut into the bowl 42. The slot 40 has a wide portion opening in the rim 44 of the bowl 42 and tapers down towards the other end 46. The general direction of the slot 40 corresponds to the rotation of the fork such as explained in the original disclosure, i.e. as illustrated by arrow B in FIG. 6, in a clockwise direction for a right-handed person.

The slot 40 has preferably no sharp angles and accordingly, the end 46 as well as the corners 48 and 50 are rounded. The bottom of the bowl is provided with a small hole 52 for locating the central tine of the fork.

Figure 5:
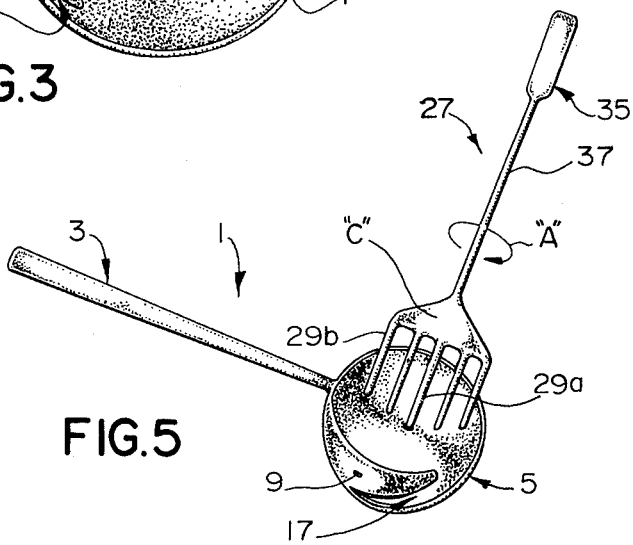
FIG. 5 illustrates how both the spoon-like and fork utensils are used together.
Figure 8:
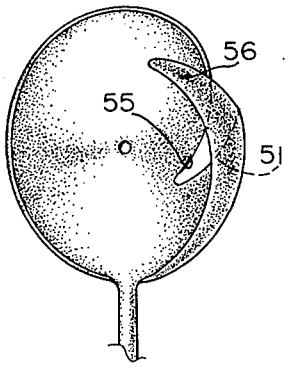
FIGS. 8 and 9 are a top and side views respectively of still another embodiment.
Figure 9:
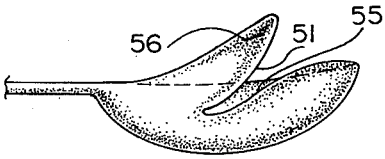

Another embodiment of the invention is illustrated in FIGS. 8 and 9 which essentially corresponds to the embodiment shown in FIGS. 6 and 7 but wherein a part of the rim located between the handle and the slot extends over the bowl in a form of a tongue 56. This tongue 56 serves essentially the same purpose as the dome 9 shown in FIG. 5 but has a much smaller area. It is also intended for curving the stranded food into a ball. However, when the tongue 56 is limited to a small size, it will not prevent the spoon from being stacked one over the other for packaging purposes.

Figure 10:
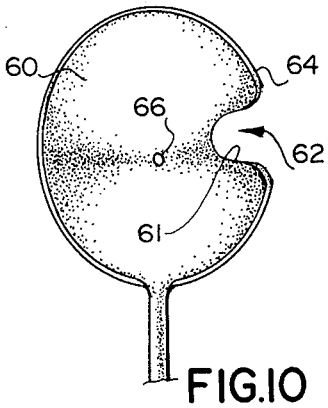
FIG. 10 is a top view of a further embodiment.

In FIG. 10, the bowl 60 of the spoon-type utensil is provided with a triangular slot 62 which opens on the rim 64 and is tapering substantially in the direction of the center 66 of the bowl 60.

In FIGS. 6 and 7, the slot 40 is provided with cutting edges 41 and 45 so that when the spaghetti is rotated with the fork in the direction of the arrow B, it will be, when desired, cut by either one or both edges 41 and 45. The tongue 43 may be slightly raised as seen in FIG. 6 to facilitate its purpose of catching the stranded food. This is done by slightly pushing the tongue 43 towards the center of the sphere partly identified by the bowl. In other words, the bowl having a general radius of curvature, the distance of the tongue from the spherical center of the bowl will be shorter than the radius of curvature of the bowl. Similarly, edges 51 and 55 are cutting edges which have the same purpose as edges 41 and 45. In the embodiment shown in FIG. 10, the edge 61 of the slot 62 is sharpened or serrated for providing the desired cutting surface for the strands of food.

For additional cutting edges and to obtain a more reliable cutting operation, the opposite side of the slots shown in FIGS. 6 to 11 are generally also sharpened or serrated.

As particularly stated above for FIGS. 8 and 9, the new embodiments illustrated in FIGS. 9 and 10 are particularly useful because they are cheaper to produce than the original embodiments and also because they can be stacked one over the other within a smaller volume and for permitting more effecient packaging.

Figure 11:
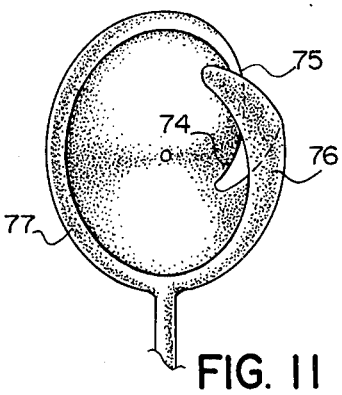
FIG. 11 is a top view of an alternative embodiment of FIG. 8.

FIG. 11 illustrates an embodiment similar to the one shown in FIG. 8 which comprises a tongue 76 plus a ledge 77 surrounding the rim of the bowl and extending over a part of its periphery. The ledge 77 ends at point 75 to free the cutting edge 74.

What I claim is:

1. A spoon-type utensil for use in eating strands of food, the utensil having a handle, a dished bowl attached to one end of the handle and an elongated tapering slot provided at least partly around the bowl of the utensil for cutting strands of food, the said slot opening on the side of the rim of the bowl and tapering down in the general direction of the handle, at least one of the edges of the said slot being a cutting edge, whereby the strands of food while penetrating into the tapering slot are gradually applied against the cutting edge to be cut.

2. A utensil as claimed in claim 1 having a crescent-shaped member overlying a portion of the bowl, one end of the member diverging away from the bowl, the convex-shaped edge of the one end providing one of the edges of the tapering slot, and a portion of the rim of the bowl adjacent the one end, providing the other edge of the slot.

3. A utensil as claimed in claim 2, wherein the other end of the member, along a portion of its convex-shaped edge, is attached to the rim of the bowl.

4. A utensil as claimed in claim 3, wherein the member is curved to provide a concave surface facing the concave surface of the bowl.

5. A utensil as claimed in claim 3, wherein a substantial portion of the concave-shaped edge of the member forms an arc of a circle.

6. A utensil as claimed in claim 5 including a depression in the concave surface of the bowl at a point defining the approximate center of the radius generating the concave-shaped edge of the member.

7. A utensil as recited in claim 1, wherein the said slot consists essentially of a tapered slot provided in the said bowl, the said slot opening through the rim of the bowl.

8. A utensil as claimed in claim 7, wherein the general longitudinal axis of the tapered slot follows a part of a spiraltype line starting from the rim of the bowl.

9. A utensil as recited in claim 8, wherein the cutting edge of the slot is provided on the curve adjacent the center of the bowl.

10. A utensil as recited in claim 8, wherein the cutting edge of the slot is provided on the curve of the slot distant from the center of the bowl.

11. A utensil as recited in claim 7, comprising a covering portion fixed to the rim of the bowl between the handle and the edge of the slot adjacent said handle and extending over a small part of the spoon.

12. A utensil as recited in claim 7, comprising a ledge around the rim of the bowl between the said handle and the edge of the slot distant from said handle, the said ledge extending over the surface of said bowl.

13. A utensil as recited in claim 8, comprising a tongue secured to the rim between the handle and the slot and extending at least partly over the slot, the distance of the tip of the tongue to the center of the bowl being shorter than the general radius of the periphery of the bowl so as to facilitate the catching of the strands of food.

14. A set of utensils for use in eating strands of food, one utensil having a handle, a dished bowl attached to one end of the handle, and an elongated tapering slot provided at least partly around the bowl of the utensil for cutting strands of food, the said slot opening on the side of the rim of the bowl and tapering down in the general direction of the handle, at least one of the edges of the said slot being a cutting edge, the other utensil having a handle and a plurality of tines extending from the handle, the ends of the tines defining a curve substantially corresponding to the concave curve of the bowl, the tines being in an odd number, the central tine projecting past the surface defining the ends of the tines and guiding means at the center of the concave surface of the bowl for receiving the tip of the central tine, to locate the other utensil in the one utensil.

15. A set of utensils as claimed in claim 14, wherein the one utensil has a crescent-shaped member overlying one side of the bowl, one end of the member diverging from the bowl to form the tapering slot in which strands are cut, the concave-shaped edge of the member having a substantial portion of its length defining an arc of a circle, the center of which is the tine receiving means.

16. A set of utensils as claimed in claim 14, wherein said other utensil has a handle with a substantially cylindrical portion axially aligned with the central tine.

* * * * *